US005137314A

United States Patent [19]

Gunter

[11] Patent Number: 5,137,314

[45] Date of Patent: Aug. 11, 1992

[54] CATWALK GRATE LIFTING TOOL

[76] Inventor: Larry W. Gunter, 615 Sandpit Rd., Leesville, S.C. 29070

[21] Appl. No.: 665,520

[22] Filed: Mar. 5, 1991

[51] Int. Cl.[5] ..... B66F 11/00

[52] U.S. Cl. ..... 294/15; 294/26; 254/131

[58] Field of Search ..... 294/15, 17, 19.1, 26, 294/9, 12; 254/131

[56] References Cited

U.S. PATENT DOCUMENTS

| | | | |
|---|---|---|---|
| 1,323,052 | 11/1919 | Haselhurst | 254/131 |
| 1,570,192 | 11/1922 | Younick | 254/131 |
| 1,794,471 | 3/1931 | Moore | 294/15 |
| 2,195,667 | 4/1940 | Baker | 254/131 |
| 2,599,938 | 6/1952 | Price et al. | 294/15 |
| 3,362,684 | 1/1968 | Davenport | 294/15 X |
| 3,836,119 | 9/1974 | Saucier, Sr. et al. | 254/131 |
| 3,837,622 | 9/1974 | Gale | 254/131 |
| 3,843,981 | 10/1974 | Verest | 254/131 X |
| 3,957,247 | 5/1976 | Haller et al. | 254/131 X |
| 3,985,338 | 10/1976 | Herrmann | 254/131 |
| 4,183,503 | 1/1980 | Ward | 254/131 |
| 4,380,326 | 4/1983 | Marzorati et al. | 254/131 |
| 4,482,182 | 11/1984 | Mortensen | 294/15 |
| 4,488,706 | 12/1984 | Kono | 294/15 X |
| 4,650,232 | 3/1987 | Perry | 294/15 |
| 4,746,098 | 5/1988 | Abarotin | 254/131 X |
| 4,826,388 | 5/1989 | Golding | 254/131 X |
| 4,838,521 | 6/1989 | Moisan | 254/131 |
| 4,991,893 | 2/1991 | Gordon et al. | 254/131 X |

FOREIGN PATENT DOCUMENTS

| | | | |
|---|---|---|---|
| 2096936 | 10/1982 | United Kingdom | 254/131 |

*Primary Examiner*—Margaret A. Focarino
*Assistant Examiner*—Joseph D. Pape
*Attorney, Agent, or Firm*—Harold M. Dixon; William R. Moser; Richard E. Constant

[57] ABSTRACT

A device for lifting catwalk grates comprising an elongated bent member with a handle at one end and a pair of notched braces and a hook at the opposite end that act in conjunction with each other to lock onto the grate and give mechanical advantage in lifting the grate.

4 Claims, 3 Drawing Sheets

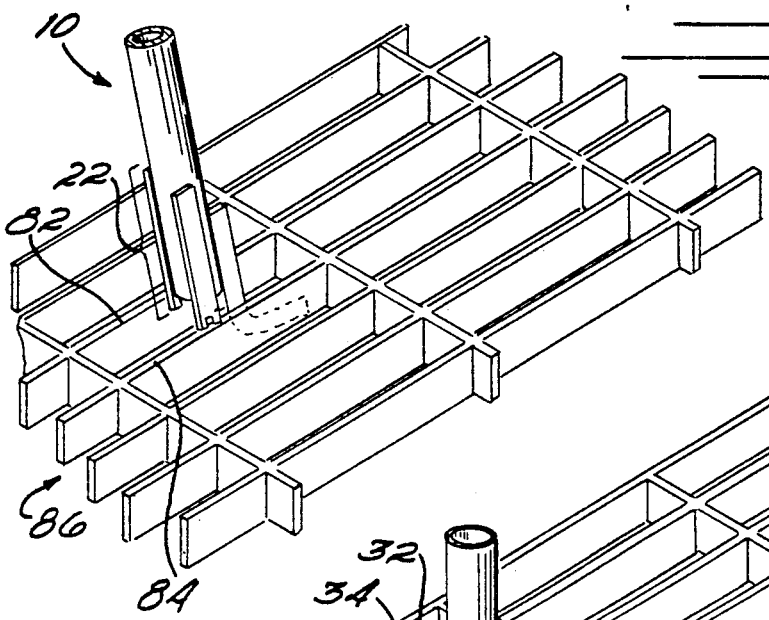
Fig. 7
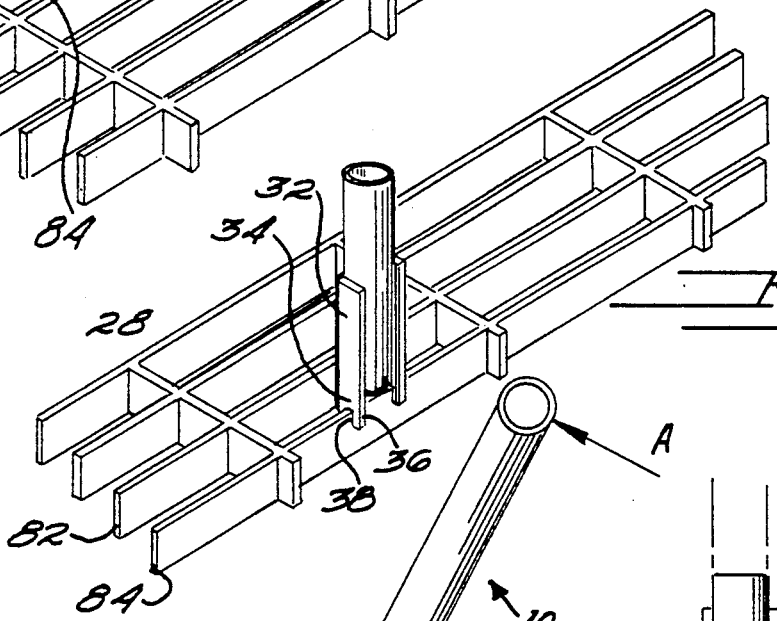
Fig. 8
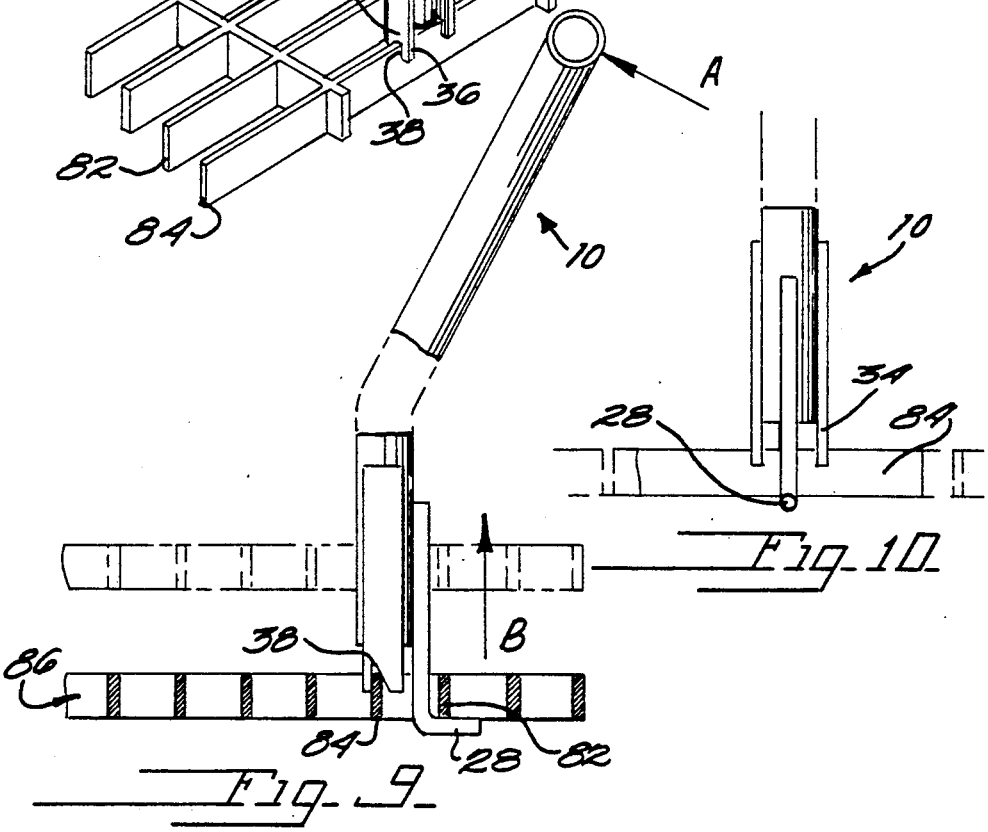
Fig. 10
Fig. 9

CATWALK GRATE LIFTING TOOL

BACKGROUND OF THE INVENTION

1. Field of the Invention

The present invention relates to lifting tools, particularly catwalk grate lifting tools. The U.S. Government has rights in this invention pursuant to Contract No. DE-AC09-89SR18035 between the U.S. Department of Energy and Westinghouse Savannah River Company.

2. Discussion of the Invention

Catwalk grating must be moved from time to time and this procedure frequently causes problems. A variety of different techniques are employed in attempting to move grating. The grate is extremely heavy and persons lifting it can strain back and abdominal muscles in the process. When the lifting is attempted with the hands, the fingers or hands may become caught under the grate causing severe injury. Pliers, hooks and other implements may be used to aid in the lifting, but these are hazardous as well.

The average grate has dimensions of approximately four feet by eight feet and weighs approximately eighty to one hundred pounds. Because the grate must support the weight of men with tools and other equipment, steel or other suitable metal alloy is employed in the manufacture. Longer slats are aligned parallel to each other with shorter slats spaced perpendicularly therebetween. All these slats are generally welded at points of contact. The present invention takes maximum advantage of this configuration to allow the grate to be lifted without direct contact with the hands.

Because a catwalk grate is so heavy, control of the tool holding the grate is essential to avoid injury. The preferred method of lifting a grate is to have two workers, each with a tool of the present invention, coordinate their actions and movements. Problems with the tools used to date are the difficulty of controlling the tool when holding the grate and the need to use much energy because of the little mechanical advantage given by the tool. There is a need for a tool that will safely transfer a catwalk grate, keeping the grate a safe distance from the worker's feet, while giving maximum control and high mechanical advantage.

SUMMARY OF THE INVENTION

In accordance with its major aspects, the present invention addresses the problems of relocating a catwalk grate. The device comprises an elongated member with a handle at one end and a grate engaging means at the other end to firmly hold the grate during the transfer process.

A feature of the present invention is the bend in the elongated member. This feature keeps the grate away from the operator during the lifting and transfer process, thus reducing the likelihood of injury.

Another feature of the present invention is the grate engaging means located at one end of the elongated member. This feature locks onto the grate and firmly holds the grate during the transfer process. The design of the grate engaging means allows the lifting tool rather than the user to carry most of the weight of the grate.

Yet another feature of the present invention is the handle. The handle, located on the elongated member opposite the grate engaging means, allows ease of holding and operating the device with the grate locked thereto. Either one or both hands may be used for the transfer process.

BRIEF DESCRIPTION OF THE DRAWINGS

FIG. 7 is a perspective of the grate engaging means of one embodiment of the present invention inserted into a grate.

FIG. 8 is a perspective of the embodiment of FIG. 7 turned approximately ninety degrees and locked onto a grate.

FIG. 9 is a side view of the embodiment of FIG. 8 in place for lifting a grate.

FIG. 10 is a front view of the embodiment of FIG. 8.

DETAILED DESCRIPTION OF PREFERRED EMBODIMENTS

Figure 1:
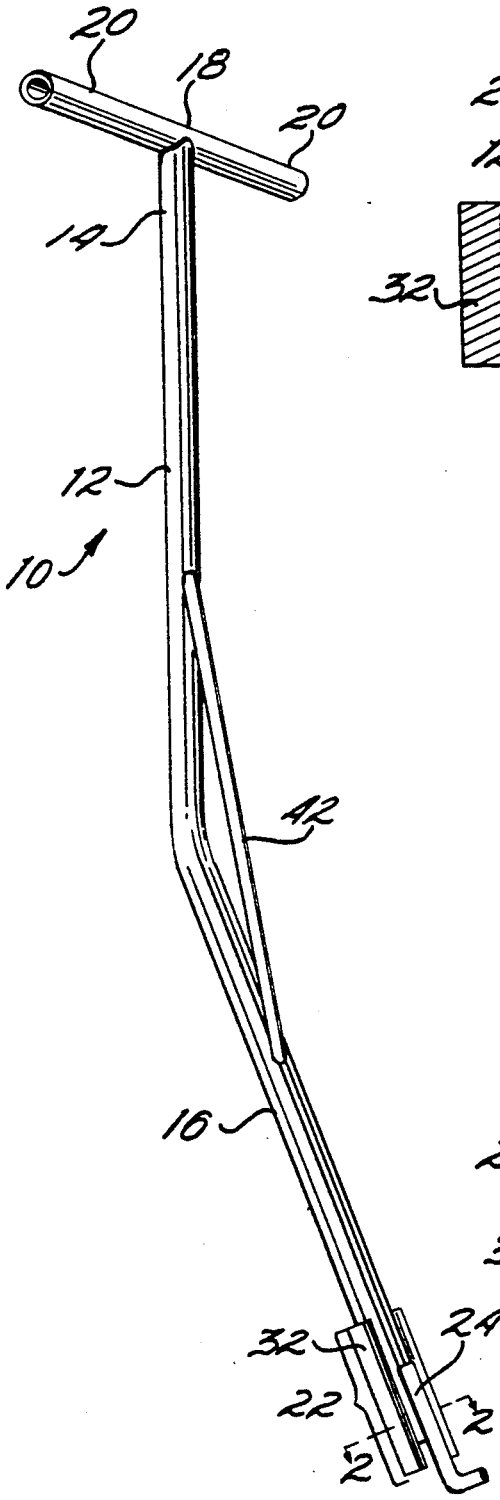
FIG. 1 is a perspective view of one embodiment of the present invention.

In the following description, FIGS. 1 through 3 and 7 through 10 refer to one embodiment and FIGS. 4 through 6 refer to another embodiment. Referring now to FIG. 1, a first embodiment of the present invention, a catwalk grate lifting tool is illustrated by reference numeral 10. Tool 10 is preferably made of a durable metal such as stainless steel or carbon steel and may be proportioned to the height of the user. Tool 10 has a substantially rigid elongate member 12 with an upper end 14 and a lower end 16. Elongate member 12 is bent along its midsection, approximately ten to twenty degrees from the perpendicular, in order to allow the catwalk grate to be moved while keeping it safely away from the feet of the user.

At upper end 14 is a handle 18 more or less centered perpendicularly atop elongate member 12. Handle 18 has hand holds 20 on either side of center for ease in holding tool 10. Tool 10 may be used with both hands or with only one hand, whatever may be the preference of the user. At lower end 16 of tool 10 is a grate engaging means 22 made of a curved hook 24 and at least one brace 32.

Figure 3:
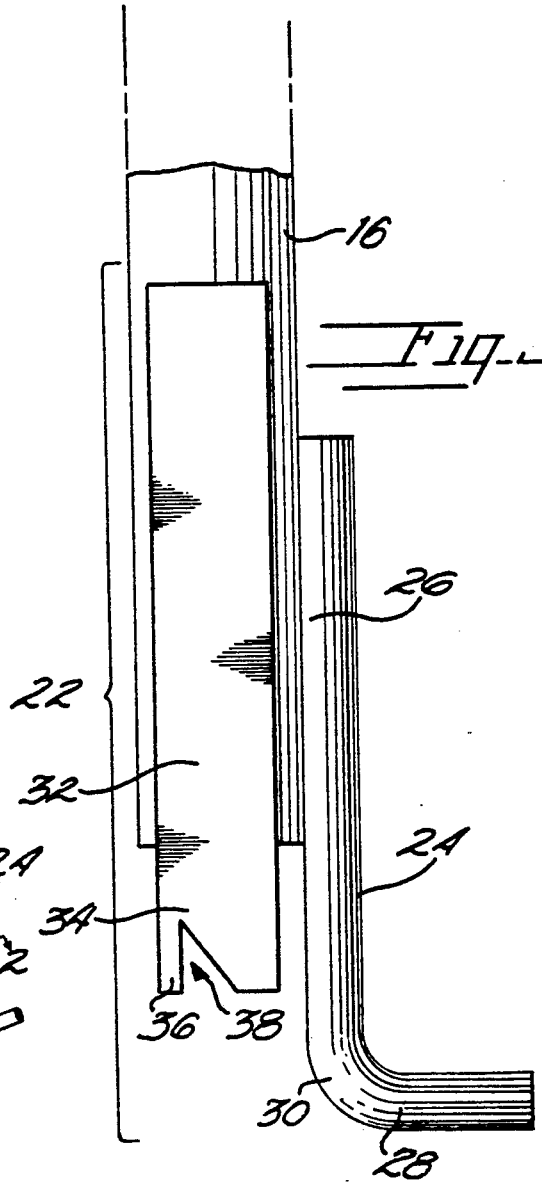
FIG. 3 is a partial side view of the hook end of the embodiment of the present invention shown in FIG. 1.

FIG. 3 illustrates lower end 16 of tool 10 in more detail. Grate engaging means 22 has a cylindrical curved hook 24 with a long portion 26 and a short portion 28 connected by an arcuate curved portion 30. Long portion 26 is welded or otherwise suitably attached to lower end 16. Grate engaging means 22 also has at least one brace 32 with a notched end 34. The end of brace 32 opposite notched end 34 is welded or otherwise suitably attached to lower portion 26. It is understood that grate engaging means 22 may be a single formed unit welded to elongate member 12 or an extension of elongate member 12 formed from lower end 16. Notched end 34 has a tooth 36 formed by a notch 38 in notched end 34. Notch 38 may be "V"-ed or "U"-ed in accordance with the grate to be lifted. When tool 10 is to be positioned for use, short portion 28 of curved hook 24 is fitted between and under cross pieces of the catwalk grate to be lifted, notched end 34 is positioned so that the cross piece of the catwalk grate just behind the cross piece under which curved hook 24 is fitted is placed inside notch 38 and tooth 36 presses against that cross piece. Notch 38 acts as a fulcrum to give levering action to the force applied to handle 18. The mechanical advantage produced is substantial.

Figure 2:
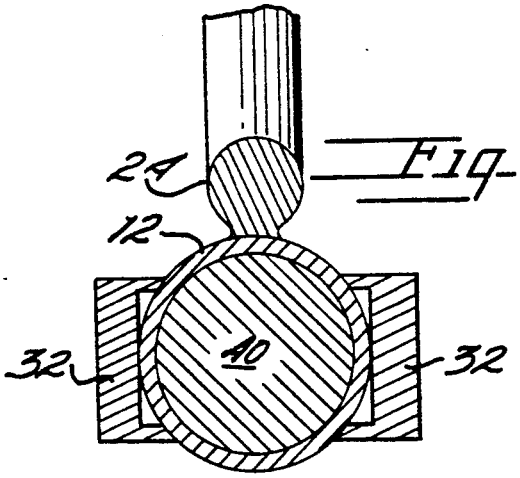
FIG. 2 is a section view of the present invention in the plane of line 2—2 of FIG. 1.

FIG. 2 shows a cross section of tool 10 along the line 2—2 of FIG. 1. Curved hook 24 and two braces 32 are welded to elongate member 12. Elongate member 12 has an inner rod 40 within lower end 16 for added rigidity and strength. Inner rod 40 is of sufficient length to extend into elongate member 12 beyond the point of the last weld. The two braces 32 are spaced opposite each other about the periphery of lower end 16 with curved hook 24 spaced halfway therebetween on the periphery of lower end 16.

A supplemental support member 42 (FIG. 1) may be welded to elongate member 12 for added strength. Supplemental support member 42 is preferably located so that it spans the bend in elongate member 12.

Figure 4:
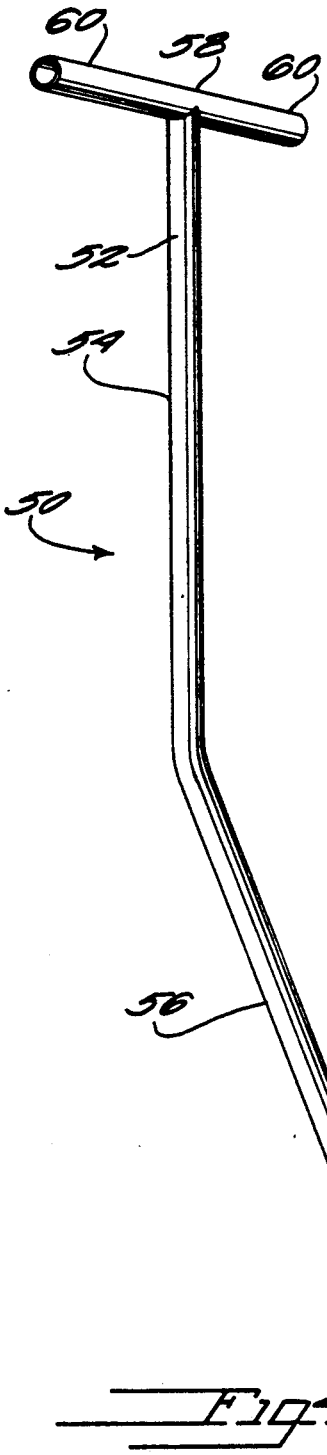
FIG. 4 is a perspective view of another embodiment of the present invention.

Referring now to FIG. 4, a second embodiment of the present invention, a catwalk grate lifting tool is referenced by the numeral 50. Tool 50 has an elongate member 52 with an upper end 54 and a lower end 56. Elongate member 52 is bent at its midsection so that the grating being moved will be kept a safe distance from the feet of the user to reduce the likelihood of injury. At upper end 54 is a handle 58 more or less centered perpendicularly atop elongate member 52. Hand holds 60 are located on either side of the center of handle 58. Lower end 56 has grate engaging means 62 made of a curved hook 64 and a pair of flanged braces 72.

Figure 6:
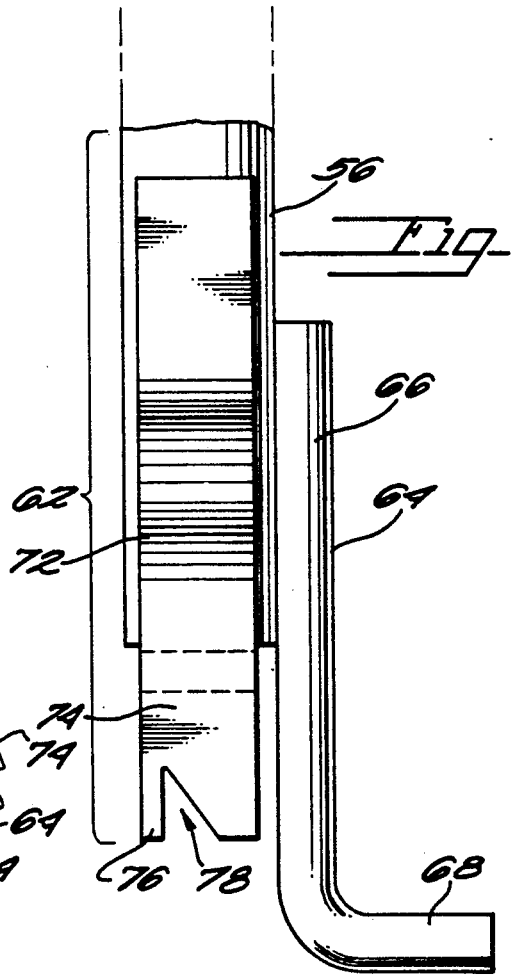
FIG. 6 is a partial side view of the hook end of the embodiment shown in FIG. 4.

FIG. 6 illustrates lower end 56 in more detail. Grate engaging means 62 has a cylindrical curved hook 64 with a long portion 66 and a short portion 68 connected by an arcuate curved portion 70. Long portion 66 is welded or otherwise suitably attached to lower end 56. Grate engaging means 62 also has a pair of flanged braces 72 each with a notched end 74. The end of each brace 72 opposite notched end 74 is welded or otherwise suitably attached to lower portion 56. Notched end 74 has a tooth 76 formed by a notch 78 therein. As in the first embodiment, notch 78 provides a fulcrum for levering the force applied to handle 58.

Figure 5:
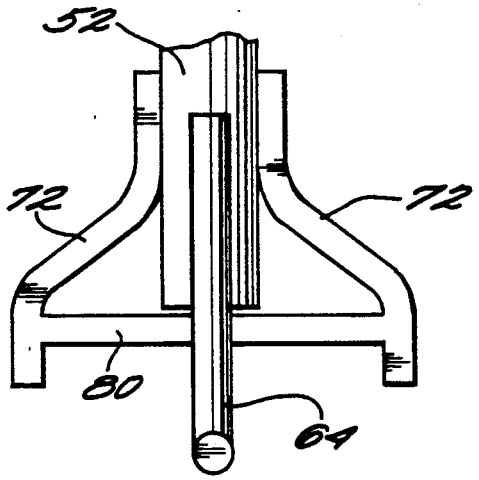
FIG. 5 is a partial front view of the hook end of the embodiment shown in FIG. 4.

Flanged braces 72 are joined by a horizontal bar 80 as shown in FIG. 5. Curved hook 64 and braces 72 are welded to elongate member 52. Braces 72 are spaced opposite each other about the periphery of lower end 56 with curved hook 64 spaced halfway therebetween on the periphery of lower end 56. Horizontal bar 80 is welded or otherwise suitably attached to braces 72 to add support and rigidity to grate engaging means.

As an example of one method of using the first embodiment of the present invention, tool 10, FIGS. 7 and 8 show a close-up of grate engaging means 22 inserted between a first slat 82 and a second slat 84 of a grate 86 to a depth sufficient to allow short portion 28 to move freely beneath slats 82, 84. By rotating tool 10 approximately ninety degrees, short portion 28 is perpendicular to and beneath slat 82. Notched end 34 of brace 32 is then located above slat 84. Notch 38 receives slat 84 and tooth 36 rides against the side of slat 84 away from slat 82. When force is applied to tool 10 to lift the grate, short portion 28 is forced against the bottom of slat 82, tooth 36 is forced against the outside of slat 84, notch 38 tightly receives the upper surface of slat 84 acting as a fulcrum, and the grate is lifted.

FIG. 9 illustrates tool 10 in position to lift grate 86. Short portion 28 in place under first slat 82 and second slat 84 within notch 38 effectively lock tool 10 onto grate 86 so that force applied in the direction of arrow A will cause grate 86 to be lifted in the direction of arrow B. By placing tools at both ends of a section of grating to be lifted, and by coordinating their movements, two workers are able to safely lift the grate and relocate it without undue strain or risk of injury.

A front view of tool 10 is shown in FIG. 10. Short portion 28 is beneath grate 86 and notched end 34 is seated on second slat 84. This configuration effectively locks grate onto tool 10 for lifting and moving.

While the invention has been described in terms of what is presently regarded as the preferred embodiment, it will be understood by those of ordinary skill in the art that various modifications and changes may be made which will nevertheless remain within the spirit and scope of the invention as defined by the claims which follow.

What is claimed is:

1. A device for lifting a catwalk grate, said catwalk grate having a plurality of spaced apart slats, said device comprising:

a hollow, elongate member having a first end and a second end;

means for gripping said elongate member at said first end;

a curved hook attached to said elongate member at said second end, said hook dimensioned for fitting between any two adjacent slats of said catwalk grate;

a rod positioned internally to said second end to reinforce said second end of said elongate member; and a pair of braces attached to said elongate member at said second end in spaced relation to said curved hook so that said braces can both engage said catwalk grate when said curved hook is inserted between said any two slats of said catwalk grate.

2. The device as recited in claim 1, wherein said at least one brace is notched to engage said slats of said catwalk grate.

3. The device as recited in claim 1, further comprising a support member attached to said elongate member between said first end and said second end.

4. The device as recited in claim 1, wherein said elongate member is bent and said device further comprises a support member attached to said elongate member between said first end and said second end.

* * * * *